United States Patent [19]

Hansel

[11] 3,996,976

[45] Dec. 14, 1976

[54] CHAMBER MANIFOLD FOR A HYDROCARBON VAPOR RECOVERY SYSTEM

[75] Inventor: William B. Hansel, Media, Pa.

[73] Assignee: Sun Oil Company of Pennsylvania, Philadelphia, Pa.

[22] Filed: Oct. 16, 1975

[21] Appl. No.: 622,933

[52] U.S. Cl. ..... 141/285; 220/85 VR

[51] Int. Cl.[2] ..... B65B 3/04

[58] Field of Search ..... 137/202, 266, 587, 588; 141/1, 5, 52, 53–61, 84, 93, 285, 289, 290, 295, 298–300, 303, 307–310, 236, 392; 220/85 VR, 85 VS, 85 S

[56] References Cited

UNITED STATES PATENTS

| | | | |
|---|---|---|---|
| 3,014,615 | 12/1901 | Stewart | 220/85 S |
| 3,807,433 | 4/1974 | Byrd | 141/290 X |
| 3,881,510 | 5/1975 | Hansel | 141/290 X |
| 3,915,205 | 10/1975 | Wagner et al. | 141/285 X |

*Primary Examiner*—Richard E. Aegerter
*Assistant Examiner*—Frederick R. Schmidt
*Attorney, Agent, or Firm*—J. Edward Hess; Donald R. Johnson; Gary V. Pack

[57] ABSTRACT

A manifold system for use in an underground hydrocarbon storage system is disclosed. The vent lines from each individual tank are connected to the manifold, and one manifold vent line extends from the manifold to a point above the surface level. A vapor return line from the manifold to a surface location for connection to a tank truck can be provided to recover the vapors displaced when the underground tanks are filled. The manifold design features a removable top for access to the float valves, thereby eliminating the need for excavation down to the manifold for maintenance. Also included in the manifold design is a feature which prevents the contamination of the unleaded gasoline by leaded gasoline.

5 Claims, 3 Drawing Figures

CHAMBER MANIFOLD FOR A HYDROCARBON VAPOR RECOVERY SYSTEM

BACKGROUND OF THE INVENTION

This invention is related to manifolds and more specifically to a manifold system for use in a hydrocarbon storage system.

Current environmental regulations require the collection of the hydrocarbon vapors generated in a hydrocarbon storage facility at service stations in certain localities. One method of recovering these vapors when filling the tanks is to connect the vent lines from each tank to the top of the tank truck so that the vapors are displaced into the tank truck as the gasoline is flowing out of the tank truck into the underground tanks. One such system which performs this function includes a manifold to which the vent lines of each tank are connected and a vapor return line connecting the manifold to a surface location. Such a system is illustrated in the copending application entitled "Vapor Recovery System for Service Stations," Ser. No. 538,057, by Wagner and Brown, filed Jan. 2, 1975 now U.S. Pat. No. 3,915,205.

A manifold system for a hydrocarbon storage facility is desirable for several reasons. One basic reason is that the use of the manifold eliminates the need for more than one vent line. In the future, the vapors from a motor vehicle fuel tank will have to be collected and returned to the underground tanks. This is best accomplished by connecting the vehicle vapor return line to a manifold so that the pressures in each tank are equalized. Equalization of the tank pressures is especially important when gasoline from two tanks are blended and the vapors are to be collected. Use of a manifold also permits the easy addition of vapor recovery components to an existing system in a manner which usually eliminates the need for excavating down to each tank, thereby minimizing the possibility of damage and the costs.

A manifold which is designed to be used in a hydrocarbon storage system should have several characteristics. A system for isolating the vent lines from the tanks containing unleaded gasoline from the vent lines of the tanks which contain leaded gasoline is required to prevent contamination of the unleaded gasoline by the leaded gasoline. The manifold structure should permit easy access to the float valves for maintenance as well as easy removal of the float valves. A third consideration is the ability to seal off the vent line to one of the tanks so that it may be tested for leaks.

SUMMARY OF THE INVENTION

In accordance with a preferred embodiment, a chamber manifold is provided for manifolding together the vent lines from underground storage tanks containing leaded gasoline or unleaded gasoline, which complies with the above requirements. The chamber manifold includes a chamber having a removable cover which is accessible through a manhole cover which is flush with the level of the service station pavement. The vent lines from the underground storage tanks enter the chamber through float valve housings mounted in the bottom of the chamber. The valve housing connected to the vent line from the tank containing unleaded gasoline has an extension, which extends nearly to the top of the chamber, to provide isolation of this vent from the vent lines of the tanks containing leaded gasoline, thereby preventing contamination of the unleaded gasoline. The vapor return line and the manifold vent line are both connected to the side of the chamber so that these lines do not become plugged by gasoline. A third connection is provided for connection to a vehicle vapor return line which receives the vapors expelled from a vehicle fuel tank when it is filled.

The removable cover for the chamber manifold has the advantage that easy access can be gained to the chamber components without the need for excavation. This feature also permits each tank to be tested for leaks by plugging the vent line going to the tank and using a column indicator at the fill tube or gauge tube connection to the tank.

A better understanding of the invention and its advantages can be seen in the following description of the Figures and the preferred embodiments.

DESCRIPTION OF THE DRAWINGS AND PREFERRED EMBODIMENT

FIG. 1 schematically illustrates an underground hydrocarbon storage facility having a vapor recovery system which utilizes the chamber manifold.

Figure 1:
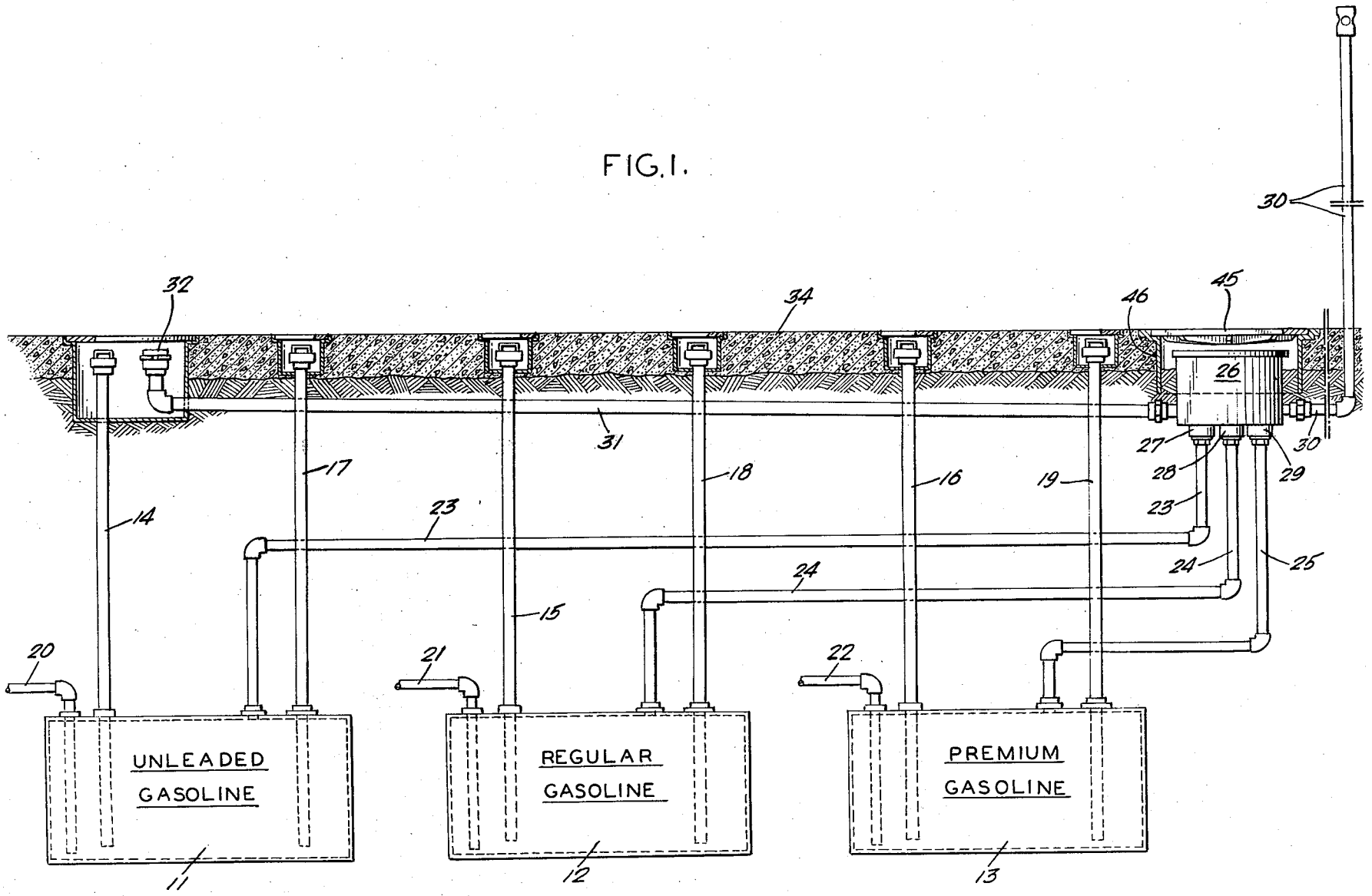

A typical underground storage tank facility includes three gasoline storage tanks 11, 12 and 13, with tank 11 being designated as the one containing unleaded gasoline. Each gasoline tank 11, 12 and 13 has a fillpipe 14, 15 and 16, a gauge line 17, 18 and 19, a suction line 20, 21 and 22 leading to the gasoline pumps (not shown), and a vent line 23, 24 and 25, respectfully. Each vent line is connected to chamber manifold 26 through valve housings 27, 28 and 29 which are mounted through the bottom of the chamber manifold. Manifold vent line 30 extends from the side of chamber manifold 26 to a point above ground level. Vapor return line 31 extends from the side of chamber manifold 26 to a surface connection 32 to which the vapor return hose of the tank truck (not shown) is connected. Chamber manifold 26 is located such that cover 33 of the manifold can be reached from the pavement surface through a manhole cover.

Figure 2:
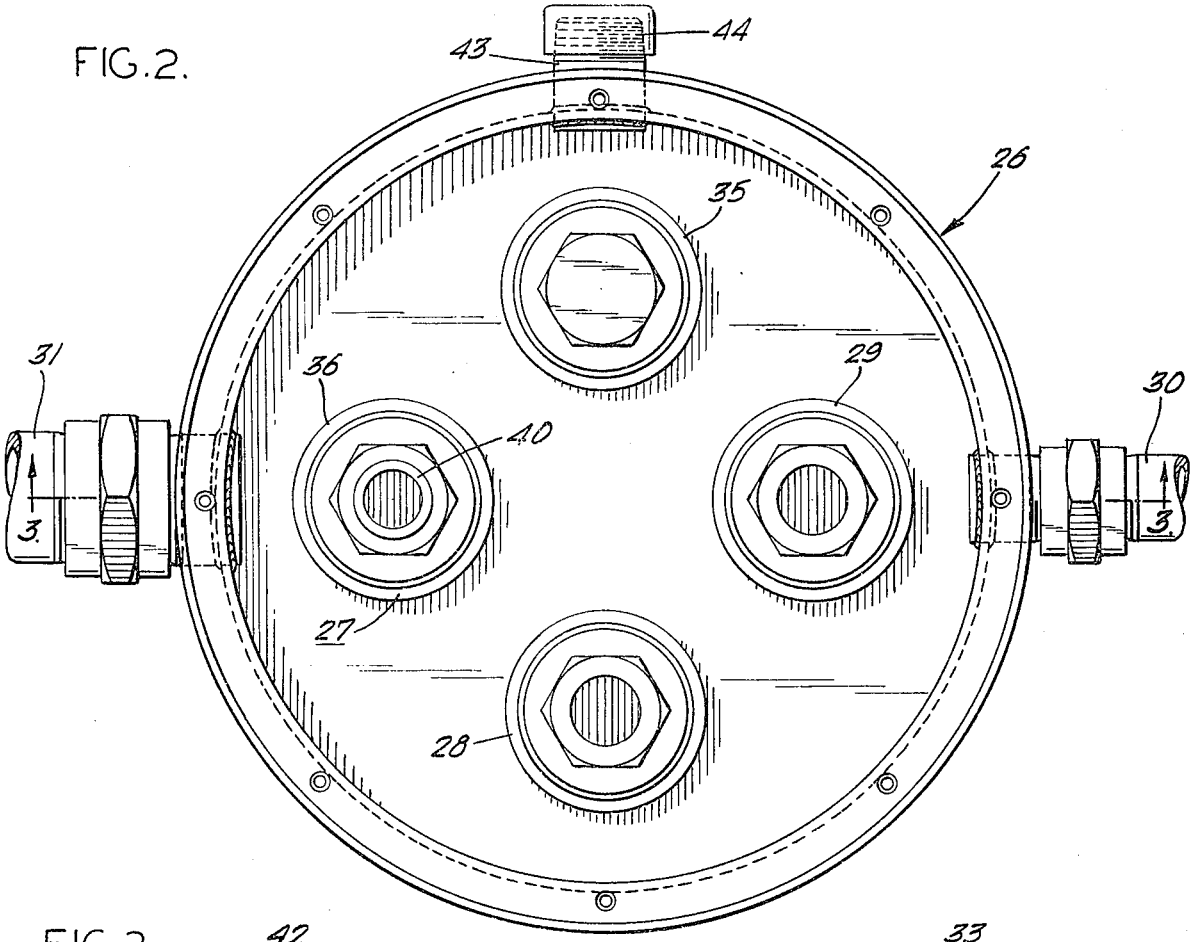
FIG. 2 illustrates a top view of the chamber manifold with the cover removed.
Figure 3:
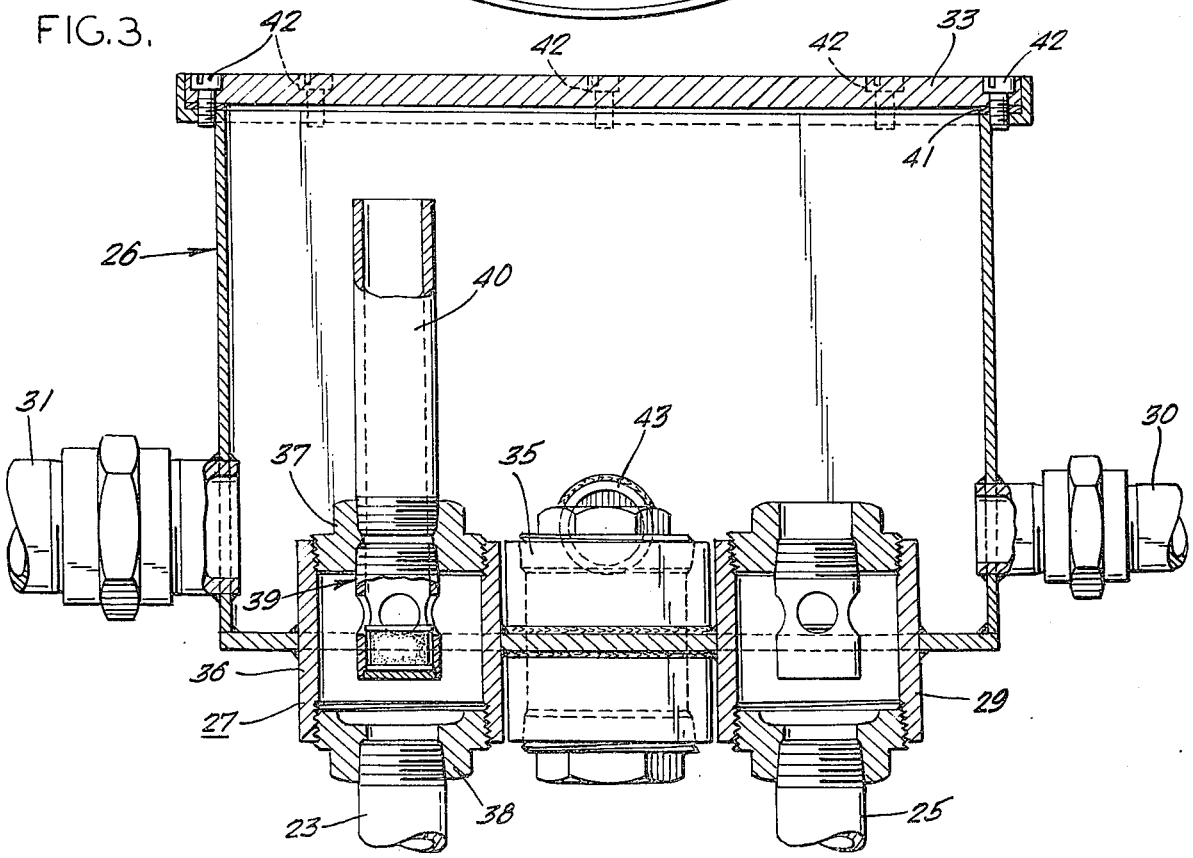
FIG. 3 illustrates a side view of the chamber manifold, partially in section.

FIGS. 2 and 3 show more detail of the design of chamber manifold 26. The exact shape of the manifold is not important, therefore, the cylindrical shape illustrated in the Figures is by example only. Four valve housings are mounted in the bottom of chamber 26, valve housings 27, 28 and 29 for receiving vent lines 23, 24 and 25 respectfully and valve housing 35 for receiving the vent line of an additional tank which may be installed at a future time. While various valve housing designs may be used, the design illustrated in the drawings is preferred since conventional pipe fittings can be employed. Only valve housing 27 will be described since the other housings are identical. A pipe section 36, having a length sufficient to permit insertion of a float valve therein, is mounted in an opening in the bottom of the chamber. Reducer plugs 37 and 38 are threaded in the top and the bottom of pipe section 36. Float valve 39 is threadedly attached to the inside of reducer plug 37 and vent line 23 is threaded into reducer plug 38.

Since vent line 23 is connected to tank 11 which contains unleaded gasoline, an extension 40 is threaded into reducer plug 37. Extension 40 thereby prevents any leaded gasoline which may enter the manifold from draining through the valve housing for the vent line leading to the gasoline tank containing unleaded gasoline.

A cover 33 mounted on the top of chamber manifold 26 and sealed by gasket 41, provides easy access to the contents in the chamber manifold. Bolts 42 help to provide a tight seal between the cover and the chamber manifold as well as to prevent tampering with the manifold or accidental opening of the cover. A manhole cover protects the chamber manifold from the weight of motor vehicles and permits easy access to manifold cover 33 by removal of manhole lid 45 from the manhold frame 46.

The preferred design for the float valve to be used in the valve housings is described in detail in copending patent applications entitled "Float Valve for Use in Vapor Return Lines," Ser. No. 538,053, filed Jan. 2, 1975, and "Quick Response Float Valve for Use in Vapor Return Lines," Ser. No. 532,028, by Hansel and Wagner, filed Apr. 28, 1975 now U.S. Pat. No. 3,958,591. The float valve described in these applications is designed to prevent premature closing of the float valve due to the extremely high velocity of the vapors flowing through the valve by preventing the vapors from flowing directly against the float and designed to permit fast closing of the float when the gasoline flows through the vent lines and reaches the valve housing.

When filling the underground tanks in a system using the chamber manifold, the vapors displaced from the tanks travel through their respective vent lines and valve housings. In the chamber manifold, the vapors from each of the tanks are then combined and forced out of the chamber through vapor recovery line 31 and into the tank truck. If by accident the underground tanks are overfilled, the float valves prevent most of the gasoline from entering the chamber manifold.

An additional connection 43 is provided on the side of chamber manifold 26 for future connection to a vehicle vapor return line for receiving the vapors displaced from the fuel tanks of vehicles when they are filled, and is covered by cap 44. Costs for installing this phase of the vapor receiving system are reduced since excavation for one line is all that will be required.

In the event of the need to test a tank for possible leaks, for example tank 11, manhole cover 45 and chamber cover 33 are removed so that reducing plug 37 with valve 39 can be removed from valve housing 27 to permit attachment of a plug (not shown) in valve housing 27. Gauge line 17 is also sealed and a column indicator is attached to the connection for fillpipe 14. During testing, the amount of liquid lost can be detected by the column indicator.

Another advantage to using the chamber manifold, is that it permits easy addition of a vapor recovery system to a conventional gasoline storage system for a service station. Excavation down to each individual tank is usually eliminated, thereby minimizing the possibility of damage to the tanks due to the excavation. Instead, the manifold is installed at a location away from the tanks where the vent lines lie in close proximity to each other, and a vapor return line can be installed from the manifold to a surface location where the tank truck vapor recovery hose can be connected. Also, this system permits the length of the vapor return line from the tanks to the tank truck to be minimized, so that the vapor recovery efficiency for each location is maximized.

While a particular embodiment of this invention has been shown and described it is obvious that changes and modifications can be made without departing from the true spirit and scope of the invention. It is the intention of the appended claims to cover all such changes and modifications.

The invention claimed is:

1. In a hydrocarbon storage facility having a plurality of individual tanks, each tank having a vent line, and including a manifold system for the vent lines of each tank which is designed to permit easy access to the elements of the manifold, said manifold system comprising:

a. a container having a bottom and a sidewall;
b. a plurality of valve housings mounted in the bottom of the container;
c. means for connecting each vent line from the tanks to the lower end of its respective valve housing;
d. liquid level sensitive valving means having a closed position when the liquid level reaches the valving means and an open position at all other times;
e. means for mounting each valving means in its respective valve housing so that it may be removed through the top of the valve housing;
f. a first coupling on the sidewall of the container for connection to a manifold vent line extending to a point above the ground level; and
g. a removable cover, secured to the top of the container in a sealed manner to provide a sealed enclosure as well as to permit access to the valving means for maintenance through the inside of the manifold.

2. Manifold system recited in claim 1 further comprising a second coupling on the sidewall of the container for connection to a vapor return line extending from the container to a surface location, so that the vapor return hose for a tank truck can be connected thereto at this surface location.

3. Manifold system recited in claim 1, wherein at least one of the storage tanks contains unleaded gasoline, further comprising means, connected to the valve housing for the tank containing unleaded gasoline, for preventing the drainage of any gasoline trapped in the container through said valve housing and into the tank containing unleaded gasoline so that the unleaded gasoline is not contaminated by leaded gasoline.

4. Manifold system recited in claim 3 wherein the preventing means comprises a pipe extension mounted in the top of the valve housing for the tank containing unleaded gasoline and extending nearly to the top of the container so that any gasoline trapped in the container drains into a tank containing leaded gasoline.

5. Manifold recited in claim 1, further comprising a coupling connected to the manifold which may be utilized to provide fluid communication between the manifold and a vehicle fuel tank.

* * * * *